United States Patent [19]

Hofbauer

[11] 4,257,368

[45] Mar. 24, 1981

[54] SOUND INSULATED INTERNAL COMBUSTION ENGINE

[75] Inventor: Peter Hofbauer, Wolfsburg, Fed. Rep. of Germany

[73] Assignee: Volkswagenwerk Aktiengesellschaft, Wolfsburg, Fed. Rep. of Germany

[21] Appl. No.: 966,567

[22] Filed: Dec. 5, 1978

[30] Foreign Application Priority Data

Dec. 17, 1977 [DE] Fed. Rep. of Germany ..... 2756378

[51] Int. Cl.[3] ..... F02B 77/02

[52] U.S. Cl. ..... 123/195 C; 123/195 S; 123/198 E; 123/52 M; 181/204

[58] Field of Search ..... 123/195 C, 198 E, 195 S, 123/52 M; 181/204, 229

[56] References Cited

U.S. PATENT DOCUMENTS

| | | | |
|---|---|---|---|
| 3,949,726 | 4/1976 | List | 181/204 |
| 4,111,163 | 9/1978 | Ederer et al. | 123/52 M |
| 4,122,820 | 10/1978 | Ryberg | 123/198 E |
| 4,164,262 | 8/1979 | Skatsche et al. | 123/41.7 |

FOREIGN PATENT DOCUMENTS

| | | | |
|---|---|---|---|
| 859509 | 12/1940 | France | 123/41.7 |

*Primary Examiner*—Craig R. Feinberg
*Attorney, Agent, or Firm*—Spencer & Kaye

[57] ABSTRACT

An internal combustion engine has a plurality of air intake conduits, air intake nipples, an air filter operatively coupled to the air intake conduits, a sound insulating capsule covering the engine, and at least one inlet opening in the capsule for admitting intake air. The intake conduits are integrated in the capsule and are directly connected to the respective air intake nipples.

8 Claims, 2 Drawing Figures

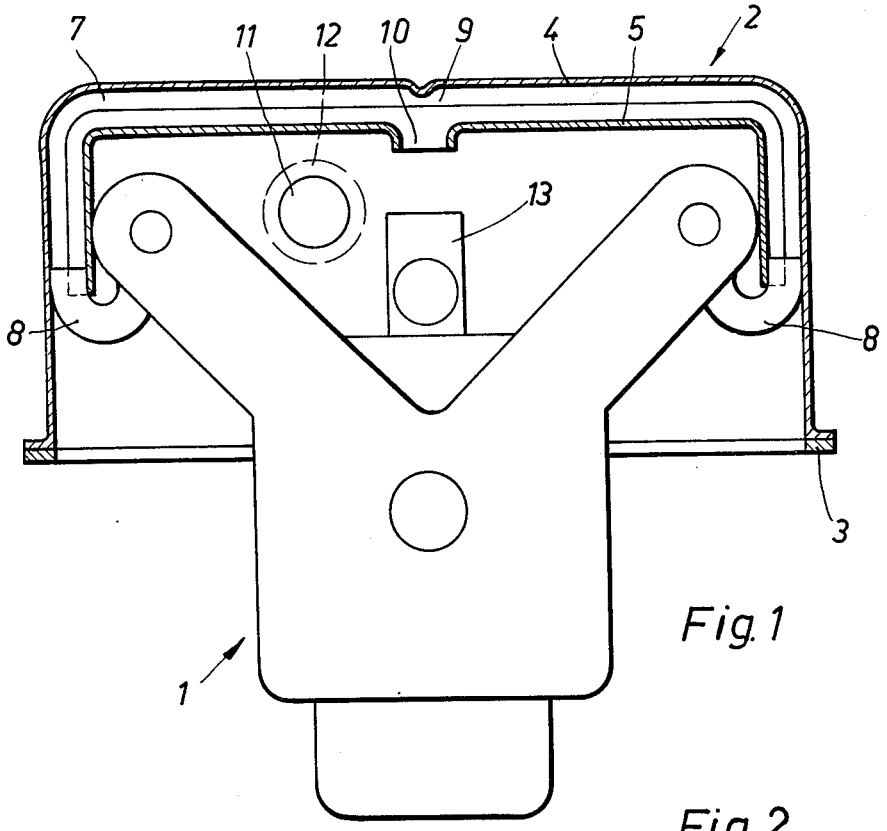
Fig. 1
Fig. 2
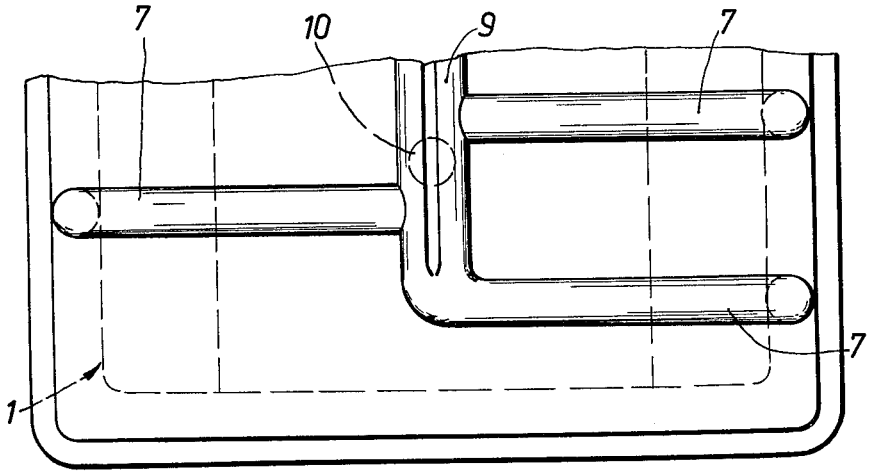

SOUND INSULATED INTERNAL COMBUSTION ENGINE

BACKGROUND OF THE INVENTION

This invention relates to an internal combustion engine encapsulated in a sound proof manner and used particularly in automotive vehicles. The engine is of the type which has a plurality of air intake conduits for supplying the combustion chambers with air and an air filter arranged upstream of the individual air intake conduits as viewed in the direction of air flow therein. The internal combustion engine is hooded with a sound dampening capsule provided with at least one air intake opening.

SUMMARY OF THE INVENTION

It is an object of the invention to provide an improved encapsulated internal combustion engine of the above-outlined type whose capsule, for further reducing sound radiation, it stiffened practically without added structural expense.

This object and others to become apparent as the specification progresses, are accomplished by the invention, according to which, briefly stated, the air intake conduits are integrated into the capsule and are directly attached to air intake nipples of the internal combustion engine.

The integration of the intake conduits into the capsule has further advantages in addition to stiffening the capsule. Thus, according to a feature of the invention, the open ends of the individual air intake conduits are, relative to the air intake opening provided in the capsule, oriented in such a manner that the combustion air, as it travels from the intake opening in the capsule, towards the inlet ends of the individual air intake conduits, sweeps over components to be cooled as it travels through the space enclosed by the capsule. Such components may be, for example, a fuel injection pump or additional engine accessories, for instance the generator of the engine. The invention makes it possible to dimension the air intake conduits practically without additional spatial requirement, as ram pipes i.e. very long tubes allowing oscillations of the air within these tubes what may be of significance in obtaining high delivery rates at low rpm's.

According to a further feature of the invention, the capsule is composed of an inner and an outer shell in which longitudinal halves of the intake conduits are formed. Preferably, the capsule halves are drawn sheet metal components, in which case the smooth surface of the intake conduits, resulting from the drawing process, have a favorable effect on the exchange of the cylinder charge.

BRIEF DESCRIPTION OF THE DRAWINGS

FIG. 1 is a schematic front elevational sectional view of a preferred embodiment of the invention.

FIG. 2 is a schematic fragmentary top plan view of the same embodiment.

DESCRIPTION OF THE PREFERRED EMBODIMENT

Turning now to the Figures, the internal combustion engine 1 proper is hooded with a capsule 2 which, in the described embodiment, is connected at its lower edge with a lower capsule (not shown) with the intermediary of an elastic sealing gasket 3. Structural details of the internal combustion engine 1 are irrelevant regarding the invention and are therefore not described.

The capsule 2 is formed of an outer shell 4 and an inner shell 5, both made by a deep-drawing process. In each shell 4 and 5 longitudinal complemental halves of a plurality of air intake conduits 7 are formed. As shown in FIG. 1, an end of each of the air intake conduits 7 is inserted over respective air intake nipples 8 affixed to the engine block of the internal combustion engine and associated with the respective combustion chambers of the engine. Additional seals or gaskets may be used if advisable.

At their ends remote from the respective nipples 8, the air intake conduits 7 merge into a common passage 9 which has a common air intake opening 10 communicating with the space enclosed by the capsule 2. The capsule 2 is provided with an inlet opening 11 through which air may enter into the space enclosed by the capsule 2 after it has passed through an air filter 12 situated at the inlet opening 11. The air intake opening 10 may be arranged in that wall of the capsule 2 which is behind the inlet opening 11. Thus, during operation of the engine, through the inlet opening 11 fresh combustion air is drawn which, before it enters into the common air intake opening 10, passes through the space defined by the capsule 2 and in so doing contacts engine components to be cooled, for example a fuel injection pump 13 arranged in that space in the path of the air stream.

The invention provides that with simple means there is achieved a reinforcement of the capsule and a reduction of the inclination to radiate sound and further, practically without added expense, the most favorable shape and length of the intake conduits may be realized. Since the intake air is used for cooling essential components of the internal combustion engine, additional blowers for achieving a large circulation of cooling air can be dispensed with. The capsule may be completely sealed from the atmosphere—with the exception of the air inlet opening—so that soiling of the components within the capsule and sound radiation through the conventionally present openings in the capsule are reduced.

As an alternative, the upstream ends of the intake conduits may merge freely into the inner space defined by the capsule—rather than being connected by the passage 9—or may even open into the atmosphere. Further, the capsule according to the invention also constitutes a sound dampener regarding air intake which means a further reduction in expenses.

It is to be understood that the above description of the present invention is susceptible to various modifications, changes and adaptations and the same are intended to be comprehended within the meaning and range of equivalents of the appended claims.

What is claimed is:

1. In an internal combustion engine including an engine block defining a plurality of combustion chambers, a plurality of air intake nipples affixed to the engine block and being associated with the combustion chambers for supplying air thereto; a sound insulating capsule covering the engine and surrounding a space about the engine; means defining an inlet opening in the capsule for admitting intake air from the outside of said capsule into said space; an intake manifold formed of a plurality of individual air intake conduits each having a downstream end connected to a respective said intake nipple;

and an air filter located upstream of the intake manifold for filtering the intake air prior to the passing of the intake air into the intake manifold; the improvement wherein said capsule has wall portions integrally constituting said air intake conduits in their entirety; further wherein said wall portions form stiffening parts of said capsule; and further wherein said air intake conduits have a free upstream end inside the capsule downstream of and spaced from said inlet opening for receiving intake air from said inlet opening.

2. An internal combustion engine as defined in claim 1, wherein each air intake conduit and the respective nipple are in an inserted relationship with respect to one another.

3. An internal combustion engine as defined in claim 1, wherein said capsule is sealed from the outer atmosphere at all locations other than said inlet opening and further wherein said air filter is arranged at said inlet opening.

4. An internal combustion engine as defined in claim 1, wherein said air intake conduits are dimensioned as ram pipes.

5. An internal combustion engine as defined in claim 1, wherein said capsule comprises an inner shell and an outer shell; each air intake conduit being formed in said inner and outer shells as complemental longitudinal halves.

6. An internal combustion engine as defined in claim 3, wherein said shells are drawn sheet metal parts.

7. An internal combustion engine as defined in claim 1, wherein an end of each air intake conduit remote from the respective air intake nipple communicates with a space surrounded by said capsule.

8. An internal combustion engine as defined in claim 7, wherein said inlet opening provided in the capsule is so positioned in relation to the ends of the air intake conduits communicating with said space that an air flow path through said space is defined for causing the intake air to contact components which are to be cooled and which are arranged in said space.

* * * * *